US005901563A

United States Patent [19]

Yarbrough et al.

[11] Patent Number: 5,901,563

[45] **Date of Patent: *May 11, 1999**

[54] HEAT EXCHANGER FOR HEAT TRANSFER SYSTEM

[75] Inventors: Merrill A. Yarbrough, Deerfield; Russell E. Lambert, Islamorade, both of Fla.

[73] Assignee: Peregrine Industries, Inc., Deerfield Beach, Fla.

[ * ] Notice: This patent is subject to a terminal disclaimer.

[21] Appl. No.: 08/985,036

[22] Filed: Dec. 4, 1997

Related U.S. Application Data

[63] Continuation of application No. 08/825,686, Apr. 1, 1997.

[51] Int. Cl.[6] ..... F25B 27/02

[52] U.S. Cl. ..... 62/238.7; 62/296; 62/434

[58] Field of Search ..... 62/238.1, 238.6, 62/238.7, 296, 434, 430

[56] References Cited

U.S. PATENT DOCUMENTS

| | | | |
|---|---|---|---|
| 2,241,070 | 5/1941 | McLenegan . | |
| 2,751,761 | 6/1956 | Borgerd . | |
| 3,017,162 | 1/1962 | Haines et al. . | |
| 3,188,829 | 6/1965 | Siewert et al. . | |
| 3,301,002 | 1/1967 | McGrath . | |
| 3,498,072 | 3/1970 | Stiefel . | |
| 3,976,123 | 8/1976 | Davies . | |
| 4,098,092 | 7/1978 | Singh . | |
| 4,238,933 | 12/1980 | Coombs | 62/238.7 |
| 4,279,128 | 7/1981 | Leniger . | |
| 4,287,722 | 9/1981 | Scott . | |
| 4,667,479 | 5/1987 | Doctor | 62/93 |
| 4,856,578 | 8/1989 | McCahill . | |
| 5,184,472 | 2/1993 | Guilbault et al. . | |
| 5,205,133 | 4/1993 | Lackstrom . | |
| 5,305,614 | 4/1994 | Gilles . | |
| 5,323,844 | 6/1994 | Sumitani et al. . | |
| 5,351,502 | 10/1994 | Gilles et al. . | |
| 5,443,112 | 8/1995 | Scheideman . | |
| 5,465,588 | 11/1995 | McCahill et al. . | |
| 5,471,851 | 12/1995 | Zakryk . | |
| 5,473,907 | 12/1995 | Briggs . | |
| 5,495,723 | 3/1996 | MacDonald . | |
| 5,560,216 | 10/1996 | Holmes . | |
| 5,573,182 | 11/1996 | Gannaway et al. . | |
| 5,575,159 | 11/1996 | Dittell . | |

FOREIGN PATENT DOCUMENTS

| | | | |
|---|---|---|---|
| 2116301 | 9/1983 | United Kingdom | 62/238.7 |

*Primary Examiner*—William Doerrler
*Attorney, Agent, or Firm*—Malin, Haley, DiMaggio & Crosby, P.A.

[57] ABSTRACT

A heat transfer system for use in cooling and dehumidifying an interior space while rejecting heat to several alternative sources. The system incorporates three primary heat transfer coils in a mechanical refrigeration cycle to provide comfort cooling to an interior space while rejecting heat to one of two primary condensing mediums. In addition the heat transfer system of the present invention functions by transferring heat from the atmosphere to a pool, thereby functioning as a pool heater. In a first operating mode heat transferred from an interior space to the ambient atmosphere. In a second operating mode heat is transferred from an interior space to pool water. In a third operating mode heat is transferred from the ambient atmosphere to pool water. A refrigerant-to-water heat exchanger is disclosed having a gas trap for isolating corrosive gases from the metallic heat exchanger components, and further including a sacrificial zinc anode for corrosion protection. A novel control system is disclosed using first and second desired pool water temperature set-points for maximizing system efficiency.

1 Claim, 8 Drawing Sheets

228
5VDC
Vref.
24 VAC
24VDC
24 VAC POWER IN
204
214
S.V. 72
210
215
POOL
PUMP
211
POOL PUMP COUNTER
REV.
VALVE
216
COMP.
POOL DEMAND
200
212
218
HOUSE DEMAND
206
208
220
222
HIGH PRESSURE SWITCH
LOW PRESSURE SWITCH
FLOW SWITCH #1
224
FLOW SWITCH #2
226
5.0 VDC Vref.

HEAT EXCHANGER FOR HEAT TRANSFER SYSTEM

This application is a continuation of application Ser. No. 08/825,686, filed Apr. 1, 1997.

BACKGROUND OF THE INVENTION

1. Field of the Invention

The present invention relates to mechanical heat transfer systems, and more particularly to a comprehensive and versatile heat exchanger and heat pump and related apparatus for, among other things, selectively cooling domestic air space and/or heating domestic and/or swimming pool water.

2. Description of the Background Art

Mechanical heat pump systems are well known in the art for absorbing heat from one medium and transferring the heat to another medium. In a conventional mechanical refrigeration system a pair of heat exchangers are fluidly connected in a refrigeration circuit, through which a cooling or heating medium (hereinafter "refrigerant") flows. According to the circulation direction of the refrigerant, one heat exchanger functions as an evaporator and the other heat exchanger functions as a condenser.

A common commercial embodiment of mechanical refrigeration is found in residential and commercial air conditioning systems. Such systems may be either "packaged" wherein all of the necessary components are packaged in a single unit, or "split" systems wherein the evaporator is separated from the compressor and condenser.

Furthermore, the need for heating domestic potable and swimming pool water is well recognized in the prior art. In warm climates the use of a swimming pool may be limited to those months where the ambient temperature is sufficient to warm the swimming pool water to a comfortable level. In colder climates, swimming pool water must be continually heated in order to provide comfortable aquatic recreation. In addition, there exists a number of other needs and uses for warmed water including domestic hot water and water used for irrigation.

A number of references are directed to providing a mechanical system capable of heating a water source. For example U.S. Pat. No. 5,560,216, issued to Holmes, discloses a combination air conditioner and pool heater. U.S. Pat. No. 4,688,396, issued to Takahashi, discloses an air conditioning hot-water supply system. U.S. Pat. No. 5,184,472, issued to Guilbault et al., discloses an add on heat pump swimming pool control. U.S. Pat. No. 4,667,479, issued to Doctor, discloses an apparatus for heating, cooling and dehumidifying the enclosure air from an indoor swimming pool while simultaneously heating or cooling the pool water. U.S. Pat. No. 4,279,128, issued to Leniger, discloses a swimming pool heating system which utilizes a pump that is used for heating heat transfer fluid which is circulated through the primary coil of a heat exchanger.

U.S. Pat. No. 4,232,529, issued to Babbit et al., discloses a mechanical refrigeration system for selectively heating swimming pool water. Babbit et al. discloses three operating modes for selectively transferring heat. In the first mode, heat is transferred from the atmosphere to pool water. In the second mode, heat is transferred from a conditioned space to the atmosphere. In the third mode, heat is transferred from the conditioned space to pool water.

U.S. Pat. No. 4,019,338, issued to Poteet, discloses a heating and cooling system for heating pool water while providing means for cooling or heating the interior of a building. Poteet discloses a system including a compressor connected through suitable conduits to a first condenser located in a swimming pool, a second condenser, and an evaporator located in a conditioned space.

However, there are a number of inherent disadvantages present in the prior art systems. Specifically, the prior art systems fail to disclose pool water heat exchangers having means for preventing heat exchanger corrosion. In particular, when water flow in prior art refrigerant-to-water heat exchangers is interrupted, air pockets may form in high points within the tubing system. When this happens, chlorine gas escapes from the pool water and cohabits the air pockets. It has been found that accelerated corrosion of the metallic heat exchanger surfaces, such as copper-based metals, occurs at the interface of the chlorine gas, pool water, and copper tubing, leading to failure of the system. It is apparent that active corrosion occurs at an accelerated rate along boundary lines separating fluid and gas resulting in a measurable electrical voltage generated by corrosion which consumes the host metal. Over time, the copper tubing experiences repeated insult at the boundary layer where the tubing, air, and water intersect, resulting in an electrochemical half-cell effect which generates an electrical voltage while consuming the copper tubing. The problem is most pronounced in refrigerant-to-water heat exchangers wherein at least a portion of the water therein drains away from high points during periods when the circulating pump is de-energized, leaving an "air gap" in the highest point(s) in the pool water conduits. The repeated insult which occurs at the interface of the pool water/chlorine gas/copper tubing surface is driven by the half-cell effect which creates a voltage, in turn consuming the copper. Ultimately, such corrosion causes failure of the heat exchanger tubing, thereby causing loss of refrigerant and further allowing water to contaminate the refrigerant system resulting in catastrophic system failure. Thus, for a system to be sufficiently reliable and commercially feasible, there still exists a need for a heat transfer system having a corrosion resistant heat exchanger.

In addition, the presence of multiple heat transfer coils in heat exchangers having varying capacities, in a common refrigeration system, results in system problems in connection with maintaining and balancing the refrigerant charge. This problem is further compounded in system configurations wherein there is substantial distance between the various components (i.e., long conduit runs).

Furthermore, other systems fail to disclose control schemes that maximize energy efficiency by minimizing pool water pumping requirements in association with system operation. In addition, the systems of the background art fail to disclose the use of multiple thermostatic set-points for maximizing use of the refrigerant-to-water heat exchanger as a condenser thereby resulting in increased system efficiency. The present invention is directed toward overcoming these and other disadvantages in the prior art.

SUMMARY OF THE INVENTION

A heat transfer system for use in cooling and dehumidifying an interior space while using recovered heat to warm several alternative media. The system incorporates three primary heat transfer coils in a mechanical refrigeration cycle to provide comfort cooling to an interior air space while giving off heat to one of two primary condensing mediums. In addition, the heat transfer system of the present invention functions by transferring heat from the atmosphere to a pool, thereby functioning as a pool heater.

The system includes the following primary mechanical heat transfer components: refrigerant compressor; a refrigerant-to-air evaporator coil in heat transfer communication with an interior space; a refrigerant-to-air heat transfer coil (evaporator/condenser) in heat transfer communication with the ambient; a refrigerant-to-water heat exchanger in heat transfer communication with pool water. The system further incorporates controls for optimizing efficiency while maintaining pool water at or near a desired set point temperature.

The system includes the following three primary modes of operation. The first mode of operation is rather conventional wherein an interior space heat transfer coil (functioning as an evaporator) and the refrigerant-to-air heat transfer coil (functioning as a condenser) are active, and the refrigerant-to-water heat exchanger is inactive. In this mode heat is transferred from the interior space via the evaporator coil, to the ambient atmosphere via the refrigerant-to-air condenser coil.

In the second mode of operation, the interior space heat transfer coil (functioning as an evaporator) and the refrigerant-to-water heat exchanger (functioning as a condenser) are active, and the refrigerant-to-air heat transfer coil is inactive. In this mode of operation heat is transferred from the interior space via the evaporator coil, to a water heat sink, such as a swimming pool, via the refrigerant-to-water heat transfer coil acting as a condenser.

In the third mode of operation, the refrigerant-to-water heat exchanger (functioning as a condenser) and the refrigerant-to-air heat transfer coil (functioning as an evaporator) are active, while the interior space heat transfer coil is inactive. In this mode of operation heat is transferred from the ambient atmosphere via the refrigerant-to-air heat transfer coil, to a water heat sink, such as a swimming pool, via the refrigerant-to-water heat exchanger acting as a condenser.

The invention further contemplates the inclusion of an additional refrigerant-to-water heat exchanger, known in the art as a desuperheater, for transferring superheat from the compressed gas exiting the compressor to a domestic hot water tank. In addition, the system contemplates that the refrigerant-to-water heat transfer coil exists as a helical coil surrounding the compressor for improved compressor sound attenuation while further including a gas trap for isolating and discharging corrosive gas, such as chlorine, present in pool water thereby isolating the corrosive gas from the metallic refrigerant-to-water heat transfer coil. A further advantage of the present invention includes a valving configuration which causes liquid refrigerant to be stored in a length of refrigerant tubing thereby effectively increasing the refrigerant receiving capacity of the system, and thus minimizing the size of the conventional refrigerant receiver required.

Control of the refrigeration components and process is accomplished through a novel arrangement of refrigerant piping and control devices including a reversing valve, solenoid valves, check valves, and thermal expansion valves. The invention contemplates a control system which provides the user with two primary options with respect to maintaining pool water temperature. The first control option allows the user to select a pool temperature set-point to which the system will operate to satisfy regardless of the requirements of the interior space. This option utilizes a reversing valve to transfer heat from either the interior space, or the atmosphere, via the suitable coil, to the pool. The second control option allows the user to select a second pool temperature set-point, whereby the system will reject heat to the pool whenever the interior space calls for cooling without exceeding a desired maximum pool water temperature.

It is therefore an object of the present invention to provide a highly efficient heat transfer system.

A further object of the present invention is to provide a residential heat transfer system for cooling a residential dwelling while heating pool water.

Yet another object of the present invention is to provide a split system air conditioner which minimizes the size of the refrigerant receiver by storing excess liquid refrigerant in refrigerant conduit in certain operating modes thereby maximizing the allowable physical distance between the air handling unit and the condensing unit.

Still another object of the present invention is to reduce noise generated by a compressor by surrounding the compressor with a helically wound refrigerant-to-water heat exchanger which functions as a compressor sound shield.

A further object of the present invention is to provide an improved combination air conditioner and pool heater having a refrigerant-to-water heat exchanger incorporating a gas trap for minimizing corrosion.

Yet another object of the present invention is to provide an improved combination air conditioner and pool heater having a refrigerant-to-water heat exchanger having a metallic anode for substantially reducing the corrosive effects of ionic migration.

In accordance with these and other objects which will become apparent hereinafter, the present invention will now be described with particular reference to the accompanying drawings.

DESCRIPTION OF THE PREFERRED EMBODIMENTS

Figure 1:
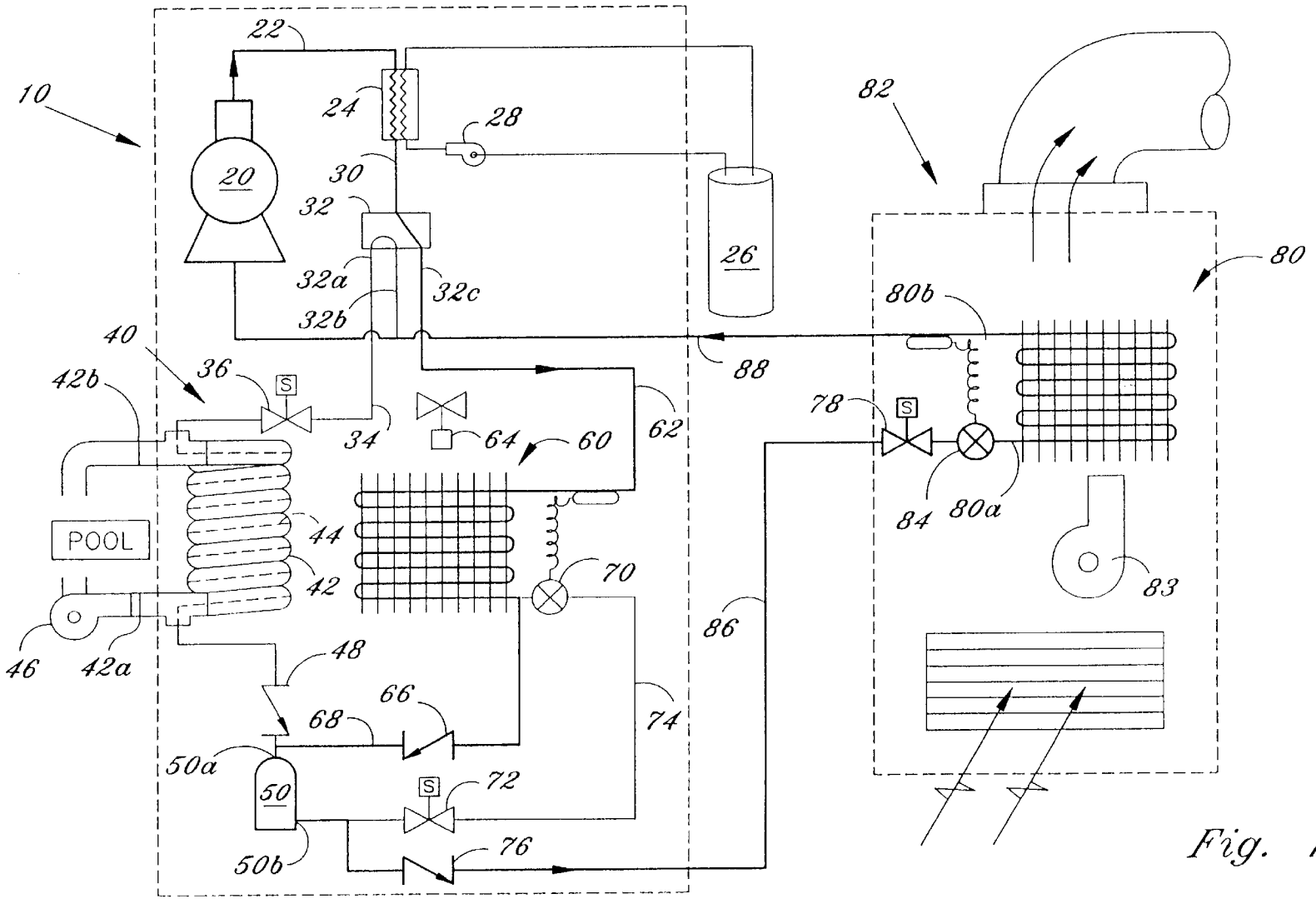
FIG. 1 is a schematic illustration of the heat transfer system operating in a mode wherein heat is transferred from an interior space to the atmosphere.
Figure 2:
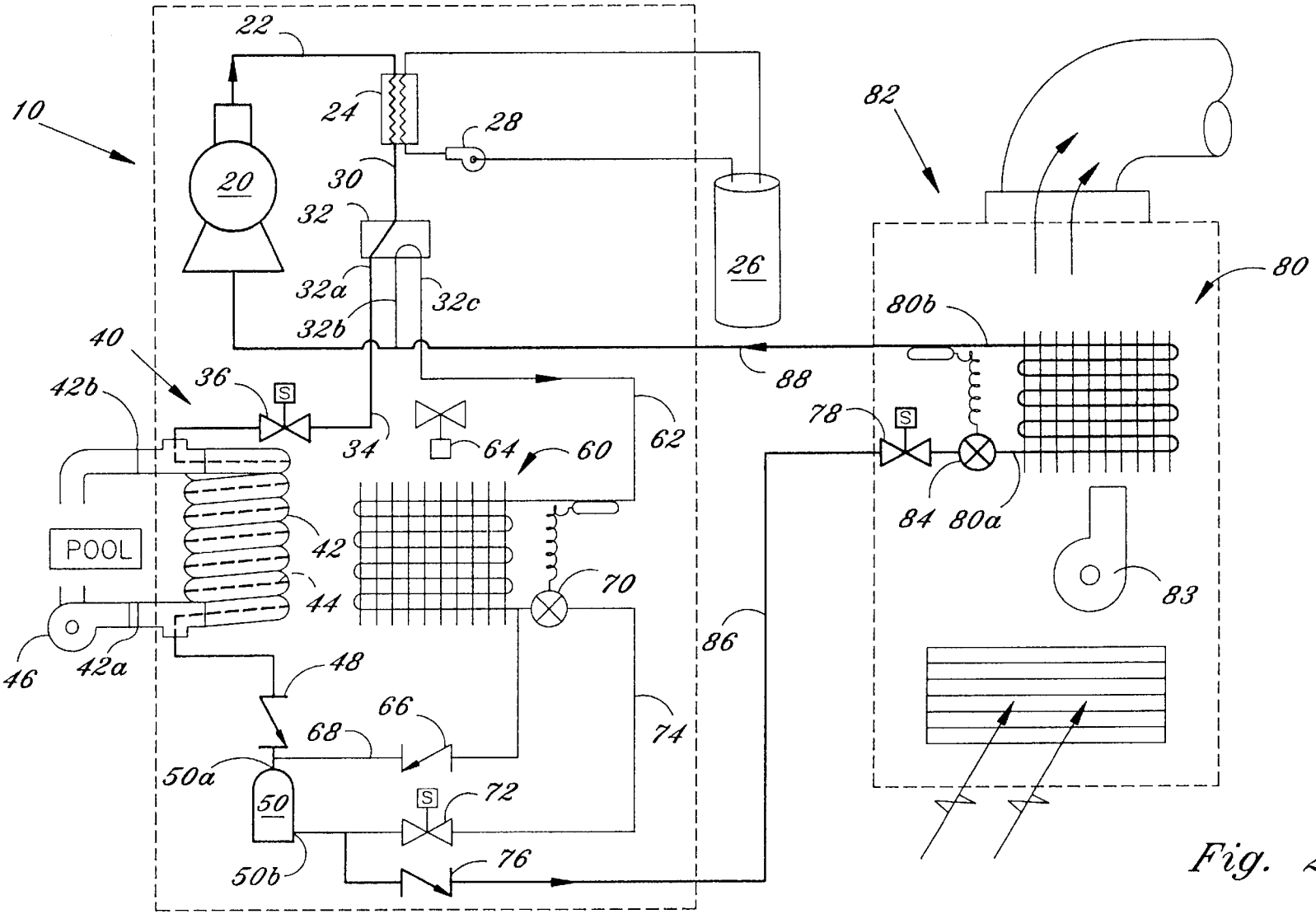
FIG. 2 is a schematic of the heat transfer system operating in a mode wherein heat is transferred from an interior space to a water medium.
Figure 3:
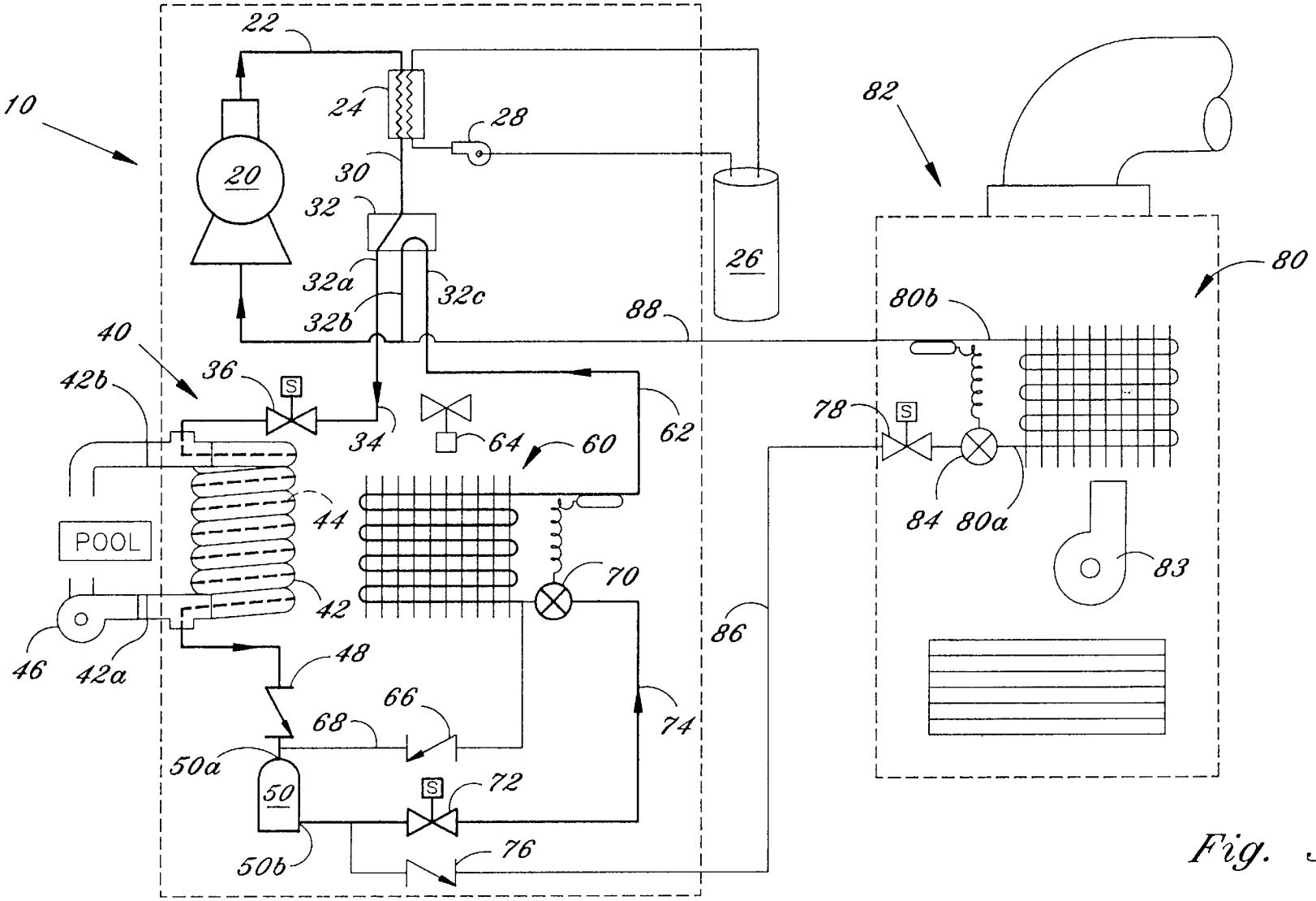
FIG. 3 is a schematic of the heat transfer system operating in a mode wherein heat is transferred from the atmosphere to a water medium.

FIGS. 1–3 show schematic representations of the mechanical refrigeration system of the present invention, generally referenced as 10, in each of three primary heat transfer operating modes, respectively. The system includes a refrigerant compressor 20 having an output in fluid communication via refrigerant tubing 22 to a desuperheater 24. Compressor 20 may be a compressor of any suitable type such as reciprocating, rotary, scroll, screw, etc., and is powered by any conventional power source. Desuperheater 24 includes an refrigerant-to-water heat exchanger for transferring superheat from compressed refrigerant gas to a domestic hot water tank 26 via a pump driven water circulation circuit 28. Desuperheater 24 has an output in fluid communication with a reversing valve 32 via refrigerant tubing 30. Reversing valve 32 includes three output ports 32*a–c* respectively. Reversing valve output 32*a* is in fluid communication with a refrigerant-to-water heat exchanger 40 via refrigerant tubing 34 and optional solenoid valve 36 (S.V.-36 or optional solenoid valve). Solenoid valve 36 is optional in the present invention and is energized whenever reversing valve 32 is energized.

Heat exchanger 40 comprises a refrigerant-to-water heat exchanger including a helically wound water conduit 42 having a helically wound refrigerant conduit 44 axially disposed therein. Water conduit 42 is in fluid communication with pool water via a pool water circulating circuit including a pool pump 46 and water conduit input 42*a* and output 42*b*. Refrigerant conduit 44 is in fluid communication with check valve 48 and a refrigerant receiver 50 having an input 50*a* and an output 50*b*.

Reversing valve output 32*c* is in fluid communication with a refrigerant-to-air heat transfer coil 60 via refrigerant tubing 62. In the preferred embodiment heat transfer coil 60 comprises a fin and tube heat exchanger, wherein refrigerant flows through tubes 61, and includes a fan 64 for forcing ambient air across coil 60. Heat transfer coil 60 is in fluid communication with check valve 66 and receiver 50 via refrigerant tubing 68. Heat transfer coil 60 further fluidly communicates with receiver output 50*b* via a thermal expansion valve 70 and solenoid valve 72 (S.V.-72 or first solenoid valve) via refrigerant tubing 74. It is important that tubing 68 is in fluid communication with heat transfer coil 60 at a T-connection located between coil 60 and thermal expansion valve 70 as depicted in FIGS. 1–3, since, when coil 60 functions as a condenser, liquid refrigerant flows to receiver 50 without having to traverse thermal expansion valve 70.

Receiver output 50*b* is in fluid communication with evaporator coil 80. In the preferred embodiment evaporator coil 80 comprises a fin and tube heat transfer coil located in an air handling unit, generally referenced as 82. Evaporator coil 80 includes a refrigerant input 80*a* and output 80*b*. As depicted in FIGS. 1–3, receiver output 50*b* is in fluid communication with evaporator coil input 80*a*, through check valve 76, solenoid valve 78 (S.V.-78 or second solenoid valve), and thermal expansion valve 84, via refrigerant tubing 86. Evaporator coil output 80*b* is in fluid communication with compressor 20 and reversing valve output 32*b* via refrigerant conduit 88.

All of the components, with the exception of air handling unit 82 and hot water tank 26, are packaged in a cabinet or other suitable structure. Significantly, the present invention is suitable for use with any suitable evaporator apparatus and may be installed in retrofit applications as a replacement for a conventional split system condensing unit. The components of the present invention may be selected to provide any suitable refrigeration capacity. In the preferred embodiment, the system is designed to industry standard capacities (e.g. five (5) tons or 60,000 B.T.U.'s).

I. FIRST OPERATING MODE

FIG. 1 schematically illustrates the first operating mode wherein heat is transferred from an interior space to the ambient atmosphere. In FIG. 1, the circuiting of refrigerant through the system is depicted in bold. In this operating mode heat is absorbed from an interior space by evaporator coil 80 and transferred to the ambient atmosphere by heat transfer coil 60.

In this first operating mode, solenoid valves 36 and 72 are closed, while solenoid valve 78 is open. As illustrated in FIG. 1, compressed refrigerant gas exits compressor 20 in a superheated state, whereafter the gas passes through tubing 22 and desuperheater 24 wherein at least a portion of the refrigerant's superheat is transferred to domestic water flowing through circulation circuit 28. Thereafter the refrigerant gas flows through tubing 30 and reversing valve 32 exiting reversing valve output 32*c* in route to heat transfer coil 60 via tubing 62. Fan 64 forces ambient air over coil 60 thereby causing the refrigerant gas flowing therethrough to condense to a liquid state whereafter the liquid refrigerant flows through check valve 66 and tubing 68 to receiver 50. Significantly, the liquid refrigerant is prevented from flowing through refrigerant-to-water heat exchanger 40 by check valve 48. The liquid refrigerant exits receiver 50 at outlet 50*b* and flows through check valve 76 and tubing 86 to open solenoid valve 78. The liquid refrigerant is prevented from flowing through tubing 74 and heat transfer coil 60 by closed solenoid valve 72.

In the preferred embodiment check valve 76 is located in substantial spaced relation with solenoid valve 78 such that, upon closure of solenoid valve 78, the portion of tubing 86 disposed between check valve 76 and solenoid valve 78 remains filled with liquid refrigerant thereby functioning as a refrigerant receiver for storing liquid refrigerant while evaporator coil 80 is inactive. The spaced configuration of check valve 76 and solenoid valve 78 significantly reduces the required size of receiver 50 by functioning to store liquid refrigerant thereby increasing the allowable separation distance between air handling unit 82 and compressor 20.

Liquid refrigerant passes through thermal expansion valve 84 and evaporator coil 80 by entering coil inlet 80*a* and exiting coil outlet 80*b*. Fan 83 forces air over evaporator coil 80, such that the refrigerant flowing through coil 80 absorbs heat from the air and changes to a gaseous state prior to exiting coil outlet 80*b*. The cooled air then exits air handling unit 82 and is used to condition the space in a conventional manner. Refrigerant gas subsequently returns to compressor 20 via tubing 88 whereafter the cycle is repeated.

II. SECOND OPERATING MODE

FIG. 2 schematically illustrates the second operating mode wherein heat is transferred from an interior space to any suitable water heat sink, such as a swimming pool. In FIG. 2, the circuiting of refrigerant through the system is depicted in bold. In this operating mode heat is absorbed from an interior space by evaporator coil 80 and transferred to water by refrigerant-to-water heat exchanger 40.

In this second operating mode, solenoid valve 72 is closed, while solenoid valves 36 and 78 are open. As illustrated in FIG. 2, compressed refrigerant gas exits compressor 20 in a superheated state, whereafter the gas passes through tubing 22 and desuperheater 24 wherein at least a portion of the refrigerant's superheat is transferred to domestic water flowing through circulation circuit 28. Thereafter the refrigerant gas flows through tubing 30 and reversing valve 32 exiting reversing valve output 32*a* in route to refrigerant-to-water heat exchanger 40 via tubing 34 and open solenoid valve 36.

The refrigerant gas flows through refrigerant-to-water heat exchanger 40, which comprises a refrigerant conduit 44 disposed within a water conduit 42, wherein heat is transferred from the refrigerant gas to water within conduit thereby causing the gaseous refrigerant to condense to a liquid state while raising the temperature of the water circulating within conduit 42. As is apparent from FIG. 2, pump 46 circulates water from the pool through the heat exchanger, wherein the temperature of the water is increased, and back to the pool, thereby functioning as a pool heater.

Liquid refrigerant then passes through check valve 48 to the liquid receiver 50 via receiver inlet 50*a*. Check valve 66 prevents liquid refrigerant from reaching coil 60 through tubing 68. The liquid refrigerant exits receiver 50 at outlet 50*b* and flows through check valve 76 and tubing 86 to open solenoid valve 78. The liquid refrigerant is prevented from flowing through tubing 74 and heat transfer coil 60 by closed solenoid valve 72.

Liquid refrigerant passes through thermal expansion valve 84 and evaporator coil 80 by entering coil inlet 80*a* and exiting coil outlet 80*b*. Fan 83 forces air over evaporator coil 80, such that the refrigerant flowing through coil 80 absorbs heat from the air and changes to a gaseous state prior to exiting coil outlet 80*b*. The cooled air then exits air handling unit 82 and is used to condition the space in a conventional manner. Refrigerant gas subsequently returns to compressor 20 via tubing 88 whereafter the cycle is repeated.

III. THIRD OPERATING MODE

FIG. 3 schematically illustrates the third operating mode wherein heat is transferred from the ambient atmosphere to any suitable water heat sink, such as a swimming pool. In FIG. 3, the circuiting of refrigerant through the system is depicted in bold. In this operating mode heat is absorbed from the atmosphere by refrigerant-to-air heat transfer coil 60 and transferred to water by refrigerant-to-water heat exchanger 40.

In this third operating mode, solenoid valve 78 is closed, while solenoid valves 36 and 72 are open. As illustrated in FIG. 3, compressed refrigerant gas exits compressor 20 in a superheated state, whereafter the gas passes through tubing 22 and desuperheater 24 wherein at least a portion of the refrigerant's superheat is transferred to domestic water flowing through circulation circuit 28. Thereafter the refrigerant gas flows through tubing 30 and reversing valve 32 exiting reversing valve output 32*a* in route to refrigerant-to-water heat exchanger 40 via tubing 34 and open solenoid valve 36.

The refrigerant gas flows through refrigerant-to-water heat exchanger 40, which comprises a refrigerant conduit 44 disposed within a water conduit 42, wherein heat is transferred from the refrigerant gas to water within conduit thereby causing the gaseous refrigerant to condense to a liquid state while raising the temperature of the water circulating within conduit 42. As is apparent from FIG. 3, pump 46 circulates water from the pool through the heat exchanger, wherein the temperature of the water is increased, and back to the pool, thereby functioning as a pool heater.

Liquid refrigerant then passes through check valve 48 to the liquid receiver 50 via receiver inlet 50*a*. The liquid refrigerant exits receiver 50 at outlet 50*b* and passes through open solenoid valve 72, though tubing 74 and thermal expansion valve 70 to refrigerant-to-air heat transfer coil 60 wherein the liquid refrigerant absorbs heat and changes to a gaseous state, whereafter the refrigerant gas passes through tubing 62 and reversing valve outlets 32*b* and 32*c* in a return route to compressor 20 via tubing 88 whereafter the cycle is repeated.

IV. WATER-TO-REFRIGERANT HEAT EXCHANGER

Figure 4:
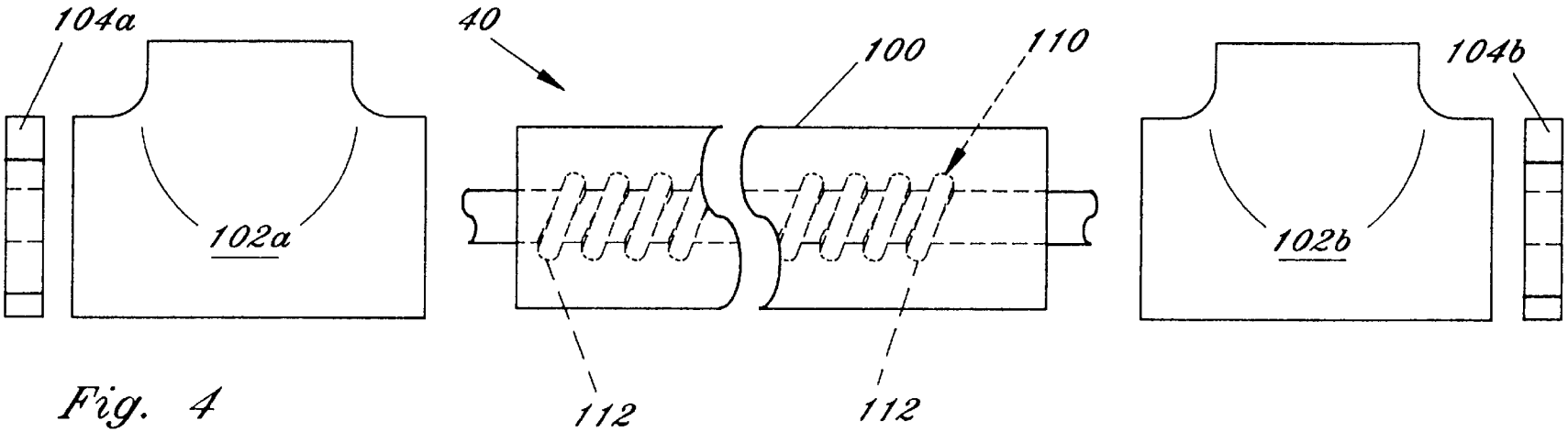
FIG. 4 is a partial exploded view of the refrigerant-to-water heat exchanger.
Figure 5:
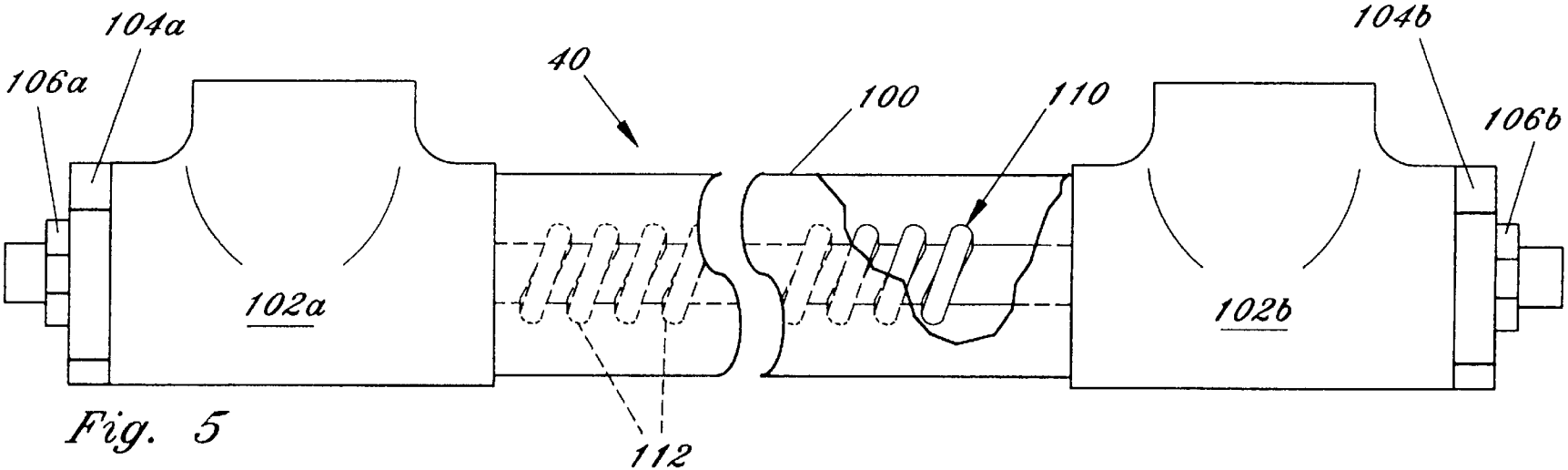
FIG. 5 is an elevational view of the assembled refrigerant-to-water heat exchanger.
Figure 6:
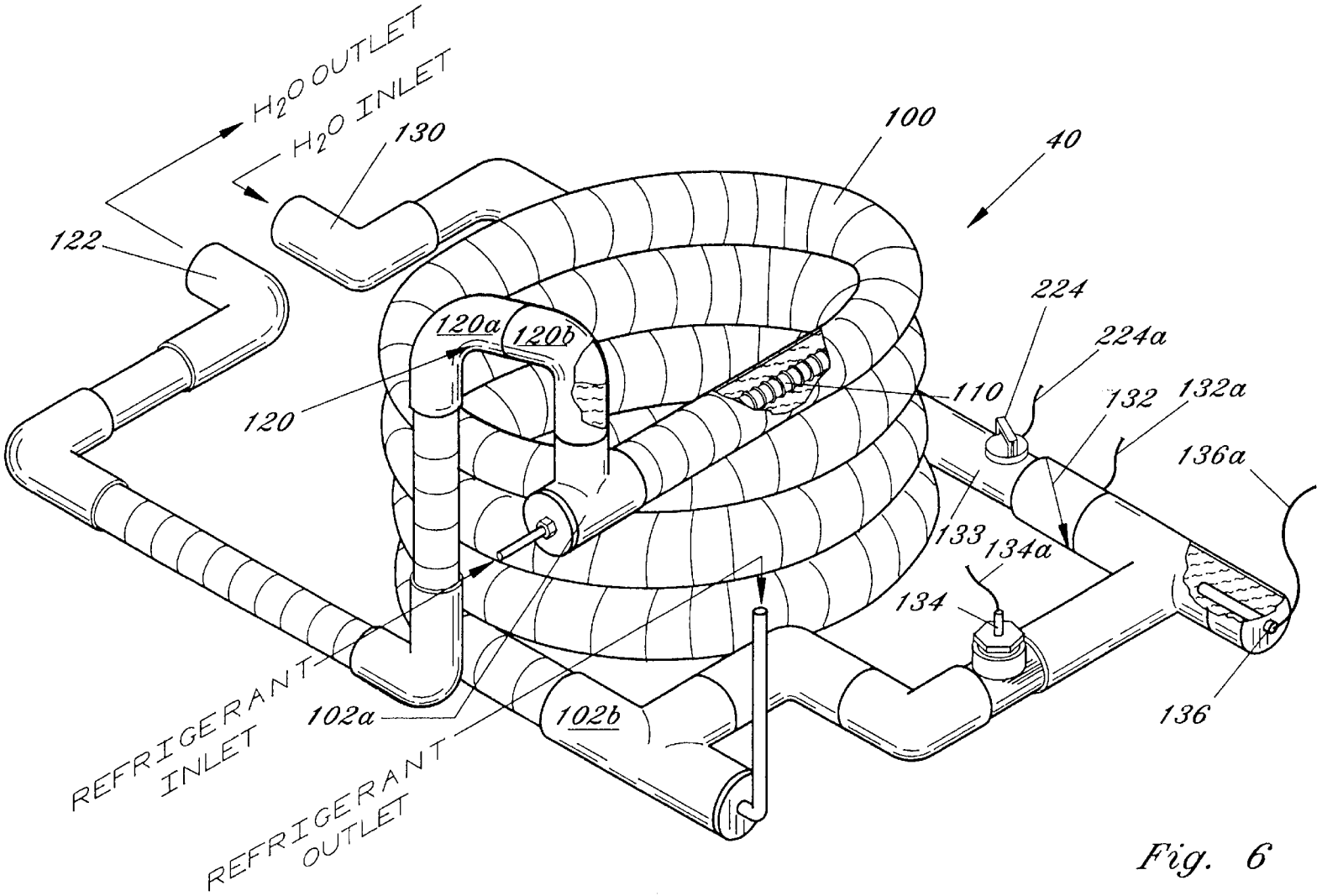
FIG. 6 is a perspective view of the refrigerant-to-water heat exchanger and associated water plumbing accessories.
Figure 7:
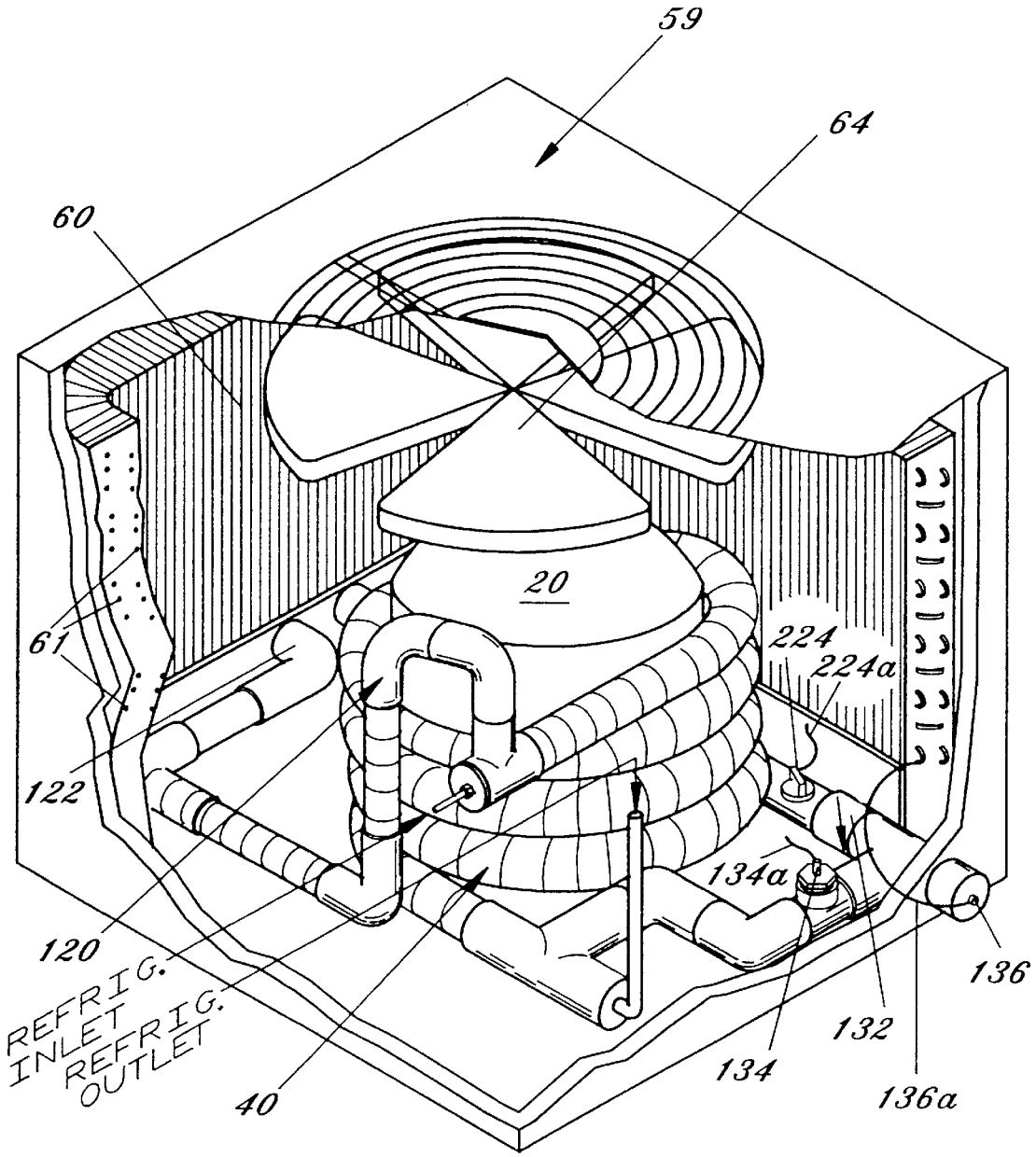
FIG. 7 is a perspective view, in partial cut-away, of the outdoor condensing/pool water heating unit of the present invention.

As best depicted in FIGS. 4–7, heat exchanger 40 comprises a coaxial heat exchanger having an outer water conduit 100 and an inner refrigerant conduit 110 disposed therein and in substantial axial alignment therewith. Outer water conduit 100 may be fabricated from any suitable material, and in the preferred embodiment is fabricated from a non-rigid, corrosion resistant material for reasons that will soon become apparent. Inner refrigerant conduit 110 may be fabricated from any suitable refrigerant tubing material, such as an alloy of copper and nickel (Cu/Ni). As best depicted in FIGS. 4 and 5, the preferred embodiment of conduit 110 defines an outer surface which has raised ridge-like features 112 such that the outer surface appears threaded thereby providing an increased outer surface area for maximizing heat transfer efficiency. Ridge-like features 112 may be continuous or discontinuous; however, any suitable inner refrigerant conduit shape, including conventional smooth tubing, remains within the scope of the present invention. Ridge like features 112 function to enhance heat transfer efficiency by increasing the effective heat transfer surface area. Heat exchanger 40 is formed by inserting refrigerant conduit 110 within water conduit 100, and bending the assembly around a mandrel or cylindrical axle (not shown) such that conduits 100 and 110 assume a helically wound shape as best depicted in FIGS. 6 and 7, when tension is removed and the assembly is allowed to relax. A significant aspect of the formation of heat exchanger 40 includes the selection of a mandrel having a predetermined diameter such that, upon the release of winding tension, conduits 100 and 110 assume a relaxed helical shaped wherein the inner conduit 110 is in substantial axial alignment with outer conduit 100, such that normal vibrations associated with the various mechanical components in the system do not result in the metal inner conduit rubbing against the inner surface of the outer conduit, which rubbing would cause failure of the outer conduit wall or inner tubing wall.

Water-to-refrigerant heat exchanger 40 further includes T-shaped water inlet 102*a* and water outlet 102*b* fittings attached at opposing heat exchanger ends as seen in FIGS. 4 and 5. As seen in FIG. 5, each T-shaped fitting includes an end piece 104*a* and 104*b* respectively, which end pieces each define an aperture therein such that opposing ends of refrigerant conduit 110 may extend therethrough for fluid connection to the refrigeration system schematically shown in FIGS. 1–3. Fittings 106*a* and 106*b* provide a positive, water-tight, seal between each end piece aperture and the portion of the inner conduit extending therethrough.

T-shaped fittings 102*a* and 102*b* are connected to further water carrying components, and specifically, fitting 102*a* is fluidly connected to a vertically extending gas trap, generally referenced as 120. In the preferred embodiment trap 120 is formed from a pair of PVC elbow fittings 120*a* and 120*b*. Gas trap 120 functions to trap naturally present corrosive gas, such as chlorine, during periods when water is not circulating through heat exchanger 40. Accordingly, the present heat exchanger improves over prior art pool water heat exchangers by maintaining a refrigerant conduit totally submerged in water, due to its vertical helical configuration and gas trap, and thus isolated from corrosive chlorine gas, at all times. Gas trap 120 is in fluid communication with a water outlet 122 as illustrated in FIG. 7. Gas accumulating in trap 120 is blown-out during the next cycle wherein the pool water pump forces pool water to flow through the heat exchanger.

The heat exchanger assembly is further connected to pool water inlet plumbing that includes a water inlet 130 in communication with a pool water circulating pump. Water inlet 130 includes a pressure actuated flow switch 224 and an inlet water check valve 132 which functions to prevent a reverse flow, or draining, of pool water upon shut-down of the pool pump thereby maintaining a sufficient level of pool water to keep refrigerant conduit 110 submerged. Accordingly, refrigerant conduit 110, which may comprise copper tubing, remains isolated from corrosive chlorine which accumulates in trap 120. It is important that flow switch 224 be located on the inlet side of check valve 132, since the water conduit upstream of check valve 132 is under hydrostatic pressure when the pool pump is de-energized. Flow switch 224 includes a conducting wire 224*a* for electrical communication with control components.

Disposed in the water conduit fluidly connecting check valve 132 and T-shaped fitting 102 are a water temperature sensor 134 and a metallic anode 136. As depicted in FIG. 7, anode 136 is connected to a common Cu/Ni system component, such as heat transfer coil 60, by an electrical conductor 136*a*. In the preferred embodiment anode 136 comprises zinc, or any other suitable base metal having electrochemical properties such that oxidation consumes the anode prior to consuming other metallic system components. In electrochemical terms, the presence of two dissimilar metals such as Zinc and Copper, in a electrolyte solution (e.g. pool water), results in an electrode potential. In this situation, electrons flow from the Zinc to the Copper via conductor 136*a*, thereby resulting in the oxidation of the Zinc anode. The electrode potential of all metals (and therefore their corroding tendencies) are known, and typically referenced to a standard hydrogen electrode. Specifically, the electrode potential of Zinc is 0.76 volts, while the electrode potential of Copper is −0.34 volts. Accordingly, while Zinc is used in the preferred embodiment, the invention contemplates use of any suitable anode material having an electrode potential in excess of Copper.

Anode 136 is electrically connected to a common metallic component of the system, such as coil 60 such that an electrical path between the water in heat exchanger 40 and the remaining copper elements in the refrigeration tubing network. As a result of the presence of the dominant voltage of the anode, corrosive electrochemical reactions naturally occurring within heat exchanger 40 will tend to consume anode 136, which is easily replaced during periodic maintenance, thereby saving the more critical refrigerant tubing 110. Accordingly, anode 136 functions to extend the operating life of the heat exchanger by sacrificing a replaceable anode.

As further depicted in FIG. 6, check valve 132 functions to keep water conduit 100 filled with water upon shut down of the water pumping source. FIG. 7 illustrates the major components in a partially assembled configuration within a condensing unit housing 59. As best depicted in FIG. 7 heat exchanger 40 includes a portion of water filled conduit helically encircling the compressor, whereby compressor noise is substantially suppressed resulting in quieter operation.

V. CONTROL LOGIC

Figure 8:
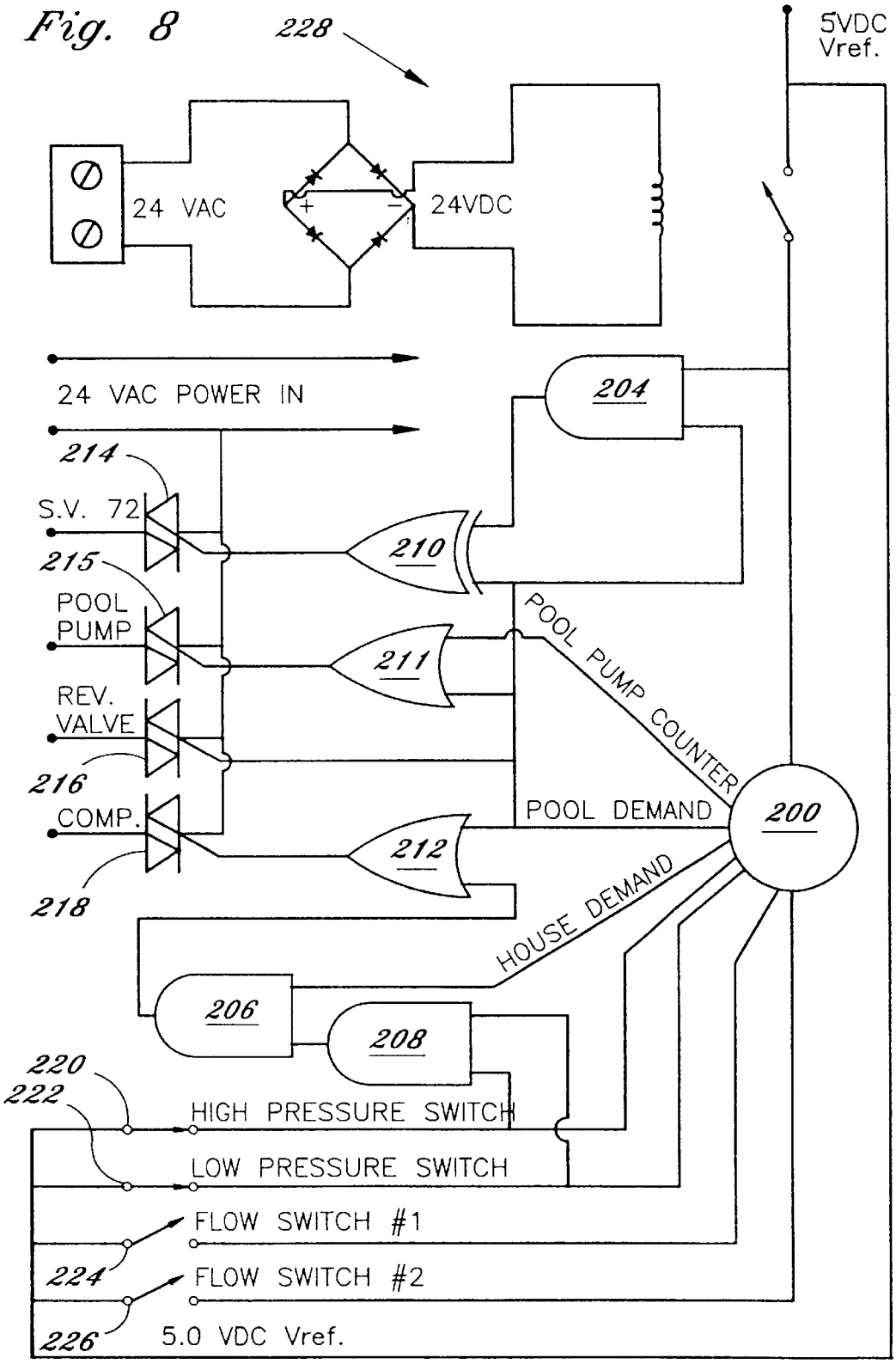
FIG. 8 is a schematic representation of the control logic for the present invention.

As schematically represented in FIG. 8, the present invention includes improved control logic and operating sequences which enhance operating efficiency while minimizing excessive cycling. The control logic is characterized as logic incorporating dual set-point parameters wherein the user may select and input the following set points: a first desired pool temperature set-point to which the system will be responsive to satisfy while utilizing heat exchanger 40 as a condenser, and either of heat transfer coils 60 or 80 (depending on interior space demand) as an evaporator; and, a second set point, higher than the first set point, wherein the pool water heat exchanger 40 functions as a condenser whenever the refrigeration system is operating responsive to interior space demand—thereby raising the pool water temperature above that of the first set-point while providing the increased system efficiency of refrigerant-to-water heat exchanger 40 over refrigerant-to-air heat exchanger 60. The control logic further uses temperature sensor 134 to sense and record the pool water temperature. The last recorded pool water temperature is retained in memory when the pool pump is deactivated. As a result, the control logic will not activate the system to satisfy the first pool water set-point unless the pool pump is running. This logic is significant since the lack of circulation in heat exchanger 40 would result in a relatively rapid fall in temperature in the water therein under certain ambient no flow conditions, which in turn would cause a periodic cycling of the system to satisfy demand as in connection with the first set-point. A corollary to this logic is that pool pump activation will be extended beyond the programmed daily cycle requirements if demand exists relative to the first water temperature set-point. As represented in FIG. 8, a preferred embodiment of the control system includes: microprocessor 200; a 5 volt direct current (5 VDC) power source 202; first, second and third AND gates 204, 206, and 208, respectively; an EXCLUSIVE OR gate 210; first and second OR gates 211 and 212; first, second, third and fourth triacs 214, 215, 216, and 218 respectively; a high pressure switch 220; a low pressure switch 222; a first water flow switch 224, and an optional second water flow switch 226; and a relay circuit 228 responsive to interior space demand.

It is further contemplated that second flow switch 226 be located in the circulating conduit of a second water source (e.g. spa), such that heat may be selectively transferred to the second water source in the event that the first water source has achieved a desired temperature. Therefore, the control logic accommodates a second set of first and second set-points in connection with the desired spa water temperatures, which spa water is typically maintained at a temperature higher than the pool water temperature. Thus, in the absence of a pool demand the system is operable to satisfy spa demand.

As is known in the control art, AND and OR logic gates receive high and low digital input signals (e.g. 1 or 0) and respond by transmitting digital output signals as follows:

| AND | | OR | | EXCLUSIVE OR | |
|---|---|---|---|---|---|
| Input | Output | Input | Output | Input | Output |
| 1,1 | 1 | 1,1 | 1 | 1,1 | 0 |
| 1,0 | 0 | 1,0 | 1 | 1,0 | 1 |
| 0,1 | 0 | 0,1 | 1 | 0,1 | 1 |
| 0,0 | 0 | 0,0 | 0 | 0,0 | 0 |

The output of exclusive OR gate 210 controls solenoid 72 (S.V.-72) via triac 214; the output of OR gate 211 controls pool pump 46 via triac 215; and, the output of OR gate 212 controls compressor 20 via triac 218. Furthermore, reversing valve 32 is controlled based on pool water temperature demand via triac 216.

The following is a description of the operation of the system's control logic with respect to the three primary operating modes disclosed herein.

Initially, the present invention contemplates a pool pump control sequence having the following characteristics. First, the system tracks the number of hours which the pool pump has been engaged while satisfying pool demand. The processor compares said number of hours with a set number of daily hours which the pool pump is programmed to run (e.g. 8 hrs.), which is dependent upon the amount of time required to adequately filter the pool. If the pool pump has been energized for at least the set number of hours (e.g. 8 hrs.) by being energized by the system during the course of satisfying pool demand during a 24 hour period, then the output of the pool pump counter, from processor 200, will be low. If, on the other hand, the pool pump has not been energized for a sufficient number of hours/minutes, then the processor will generate a high signal on the pool pump counter leg for a sufficient length of time prior to the end of a given 24 hour period to insure that the pump runs for the full set number of hours. For example, if the pool pump is programmed to run for 8 hours and the processor has logged only 6 hours of pump run time over the first 22 hours of a 24 hour period, then processor 200 will generate a high output signal on its pool pump counter output for the last two hours of the cycle, thereby providing a high input to OR gate 211 which will energize the pump via triac 215 regardless of pool temperature demand. The aforementioned pool pump control logic conserves energy by limiting excessive pump operation while insuring that the pump runs for a fixed minimum number of hours during each 24 hour period.

a. CONTROL SEQUENCE—First Operating Mode

In the first operating mode, the pool temperature is satisfied and there exists a demand for interior space cooling. As depicted in FIG. 8, normally closed pressure switches 220 and 222 electrically communicate with AND gate 208. Accordingly, if the system experiences operating conditions which exceed the high or low pressure limits, the system will be prevented from operating as the signal transmitted from AND gate 208 shall be low (e.g. 0). Conversely, under normal operating conditions pressure switches 220 and 222 are closed such that AND gate 208 transmits a high signal output (e.g. 1) to a first input leg of AND gate 206.

In the first operating mode wherein there exists an interior space demand (e.g. interior space temperature is higher than cooling set-point), processor 200 generates a high signal on the output leg labeled "house demand." Accordingly, AND gate 206 receives high signals on both input legs and thus transmits a high output which is received by OR gate 212 as an input. The remaining input leg of OR gate 212 receives signals relative to pool temperature demand. In the first operating mode wherein the pool temperature is satisfied, the pool demand signal generated by processor 200 is low. Therefore, OR gate 212 receives both low and high input signals thereby transmitting a high output signal which energizes the compressor via triac 218.

The interior space demand further causes a 24 VAC load across full bridge rectifier circuit 230 thereby closing contact 228, which results in a high input signal to AND gate 204. The lack of pool demand results in a AND gate 204 receiving a low signal at its second input, thereby resulting in a low output to exclusive OR gate 210. Accordingly, the output from gate 210 is low and thus solenoid valve 72 is not energized via triac 214. Furthermore, the lack of pool demand results in a low input to OR gate 211 which results in a low output therefrom, such that the pool pump is not energized by triac 215; unless, the second input to gate 211 receives a high signal from the processor indicating that it is necessary to energize the pool pump only to meet the programmed minimum pump run time. Accordingly, only the compressor, the outdoor condensing fan and the evaporator fan are energized and the system transfers heat from the interior space to the ambient atmosphere.

b. CONTROL SEQUENCE—Second Operating Mode

In the second operating mode, there exists a simultaneous demand for interior space cooling and pool water heating. As depicted in FIG. 8, normally closed pressure switches 220 and 222 electrically communicate with AND gate 208, and under normal operating conditions, pressure switches 220 and 222 are closed such that AND gate 208 transmits a high signal output (e.g. 1) to a first input leg of AND gate 206.

In the second operating mode wherein there exists an interior space demand (e.g. interior space temperature is higher than cooling set-point) and a pool demand (e.g. pool water temperature is less than the second, or highest pool water set-point), processor 200 generates a high signal on both the output leg labeled "house demand" and the output leg labeled "pool demand."

Accordingly, AND gate 206 receives high signals on both input legs and thus transmits a high output which is received by OR gate 212 as an input. Since the second input leg of OR gate 212 receives signals relative to pool temperature demand, the second input leg also receives a high signal from processor 200 as does triac 216 thereby actuating the reversing valve. Therefore, OR gate 212 receives both high input signals thereby transmitting a high output signal which energizes the compressor via triac 218.

The interior space demand further causes a 24 VAC load across full bridge rectifier circuit 230 thereby closing contact 228, which results in a high input signal to AND gate 204. The pool demand results in a AND gate 204 further receiving a high signal at its second input, thereby resulting in a high output to exclusive OR gate 210. Thus, gate 210 receives a pair of high input signals resulting in a low output signal such that solenoid valve 72 is not energized via triac 214. Furthermore, the pool demand results in a high input to OR gate 211 which results in a high output therefrom, such that the pool pump is energized by triac 215 thereby circulating water through heat exchanger 40. Accordingly, the compressor, the pool pump and the evaporator fan are energized and the system transfers heat from the interior space to the pool water. If, at any time during this operating cycle, the pool water reaches its maximum set-point, the system will automatically switch condensers from heat exchanger 40 to heat transfer coil 60 (unless there exists a demand from a secondary water source such as a spa).

c. CONTROL SEQUENCE—Third Operating Mode

In the third operating mode, there exists a demand for pool water heating only. Accordingly, there does not exist an interior space demand (e.g. interior space temperature at or below the cooling set-point), but there does exist a pool heating demand (e.g. pool water temperature is less than the first, or lowest pool water set-point). In this mode processor 200 generates a high signal on the output leg labeled "pool demand", however, the control logic within processor 200 is such that an indication of water flow is required before generating the high output signal; water flow is sensed by flow switch 224 (or additionally flow switch 226 if a second water source, such as a spa is connected to the system) thereby making pump operation a prerequisite to this operating mode. Accordingly, processor 200 will not send a high signal on the indicated "pool demand" leg unless (1) there exists a pool heating demand, and (2) the pool pump is running. Thus, the system does not energize the pool pump in this mode, the system does, however, track the pool pump run period using processor 200 and flow switch 224 as more fully discussed herein below.

Accordingly, AND gate 206 receives a high input signal from AND gate 208 (assuming the high and low pressures are within acceptable limits) and a low input signal from the "house demand" output leg of the processor, and thus transmits a low output to an input leg of OR gate 212. Since the second input leg of OR gate 212 receives signals relative to pool temperature demand, the second input leg receives a high signal from processor 200 in connection with pool demand. Therefore, OR gate 212 transmits a high output signal which energizes the compressor via triac 218.

The lack of interior space demand does not result in the closing of contact 228. Accordingly, AND gate 204 receives a low input (interior space demand) and a high input (pool demand) thereby generating a low output. The low output from gate 204 combines with a high output from the processor on the pool demand leg as inputs for exclusive OR gate 210, thereby generating a high output to triac 214 which energizes solenoid valve 72 (S.V.-72). As best seen in FIG. 3, energizing solenoid valve 72 allows condensed liquid refrigerant to flow through tubing 74, expansion valve 70 and refrigerant-to-air heat transfer coil 60 (functioning as an evaporator) for absorbing heat from the ambient atmosphere. Furthermore, if flow switch 224 is closed, pool demand results in a high input to OR gate 212 and EXCLUSIVE OR gate 210. Accordingly, the compressor, the pool pump, solenoid valve 72, and the condenser fan are energized and the system transfers heat from the ambient atmosphere to the pool water.

Therefore the dual pool water set-point control logic of the present invention allows the system to activate the refrigerant-to-water heat exchanger 40 whenever there exists a demand for interior space cooling ("house demand") and the pool water temperature is below the second, or highest pool water temperature set-point. This feature increases system efficiency since the refrigerant-to-water heat exchanger 40 is a more efficient condenser than is the refrigerant-to-air heat transfer coil 60. Additionally, the present invention will activate the refrigerant-to-water heat exchanger 40 regardless of house demand, whenever the pool pump is running and the pool water temperature is below the first, or lowest pool water temperature set-point.

An additional feature of the present invention includes logic for controlling the pool pump for conserving energy. In the preferred embodiment, the invention contemplates that it is desirable to run the pool pump a minimum number of hours in a twenty-four hour period to provide adequate water filtration. Since the control system of the present invention will energize the pool pump only in the second operating mode (e.g. when there exists both a "house demand" and a "pool demand") it has been found to be desirable for the processor to track pool pump run time, and, if the pool pump has not run for the desired minimum amount of time (e.g. 8 hours) in a twenty-four hour period, then the processor will energize the pool pump a sufficient amount of time prior to the expiration of the twenty-four hour period to insure that a minimum pool pump run time is achieved.

d. ALTERNATE ELECTRO-MECHANICAL CONTROL

Figure 9:
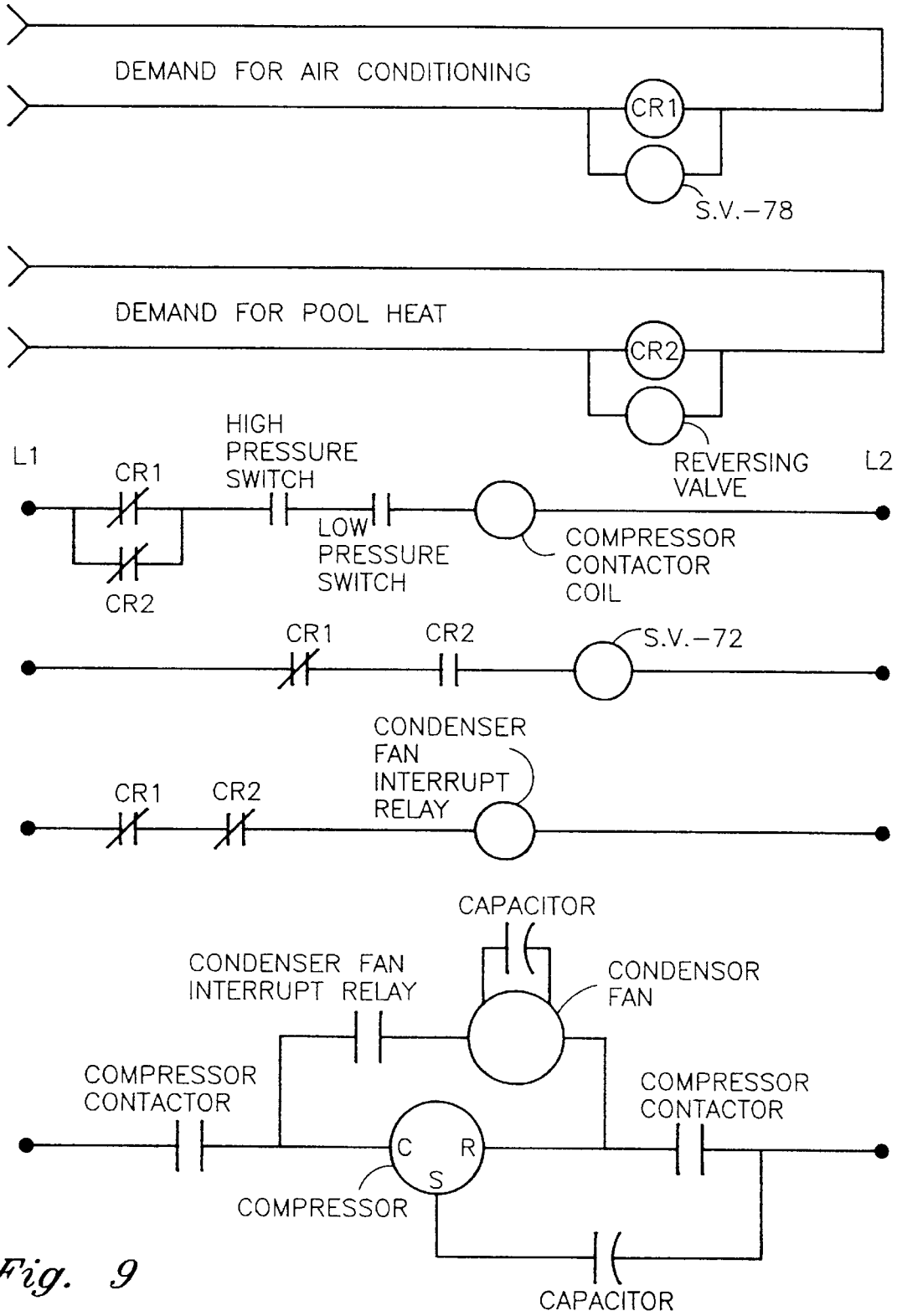
FIG. 9 is a schematic representation of an alternate electromechanical control system for the present invention.

FIG. 9 is a schematic illustration of an alternate means for controlling the heat transfer system of the present invention utilizing electromechanical controls connected to a control voltage source represented by legs L1 and L2. As depicted in FIG. 9, a demand for air conditioning energizes a first control relay (CR-1) and S.V.- 78, thereby providing cooling for the interior space. If there is no demand for pool heat, a second control relay (CR-2), and reversing valve 32 are not energized. Accordingly, heat is transferred from the interior space to the ambient atmosphere in accordance with the first operating mode disclosed herein above.

FIG. 9 further illustrates the integration of normally closed high and low pressure switches for compressor protection. If either the high or the low pressure switch is triggered (e.g. high or low refrigerant pressure limits exceeded), the compressor contactor is prevented from energizing the compressor. In addition, solenoid valve 72 is controlled by a normally closed contact responsive to CR-1 and a normally open contact responsive to CR-2. This configuration provides that solenoid valve 72 is energized only when there exists a demand for pool heat (CR-2 energized) and no demand for air conditioning (CR-1 de-energized). Finally, a condenser fan interrupt circuit prevents the condenser fan from energizing when there is a demand for both air conditioning (CR-1) and pool heat (CR-2).

The present invention has been shown and described herein in what is considered to be the most practical and preferred embodiment. It is recognized, however, that departures may be made therefrom within the scope of the invention and that obvious modifications will occur to a person skilled in the art.

What is claimed is:

1. In a heat transfer system functioning as a combination air conditioner and water heater, which system is characterized as a mechanical refrigeration system including the following components: means for compressing refrigerant gas; a first refrigerant-to-air heat transfer device and fan in communication with ambient air; a second refrigerant-to-air heat transfer device and fan in communication with air from an interior space; a refrigerant-to-water heat exchanger in communication with a water source; and mechanical refrigeration controls which enable said system to function in any one of three operating modes, wherein; in the first mode of operation said first refrigerant-to-air heat transfer device functions as a condenser, and said second refrigerant-to-air heat transfer device functions as an evaporator such that heat is transferred from an interior space to the atmosphere; in the second mode of operation said refrigerant-to-water heat exchanger functions as a condenser and said second refrigerant-to-air heat transfer device functions as an evaporator such that heat is transferred from an interior space to said water source; and, in the third mode of operation said refrigerant-to-water heat exchanger functions as a condenser and said first refrigerant-to-air heat transfer device functions as an evaporator such that heat is transferred from the atmosphere to said water source, an improvement comprising:

said refrigerant-to-water heat exchanger having an outer water conduit and an inner refrigerant conduit coaxially disposed therein, said outer and inner conduits forming a helical coil shape having an upper portion and a lower portion, said refrigerant-to-water heat exchanger disposed in substantially surrounding relation about said means for compressing refrigerant gas thereby functioning as a compressor sound shield;

said heat exchanger further including a metallic anode in fluid communication with water in said outer conduit, said anode being conductively connected to at least one of said mechanical refrigeration components, said anode characterized as an alloy having an electrode potential in excess of the electrode potential of said mechanical refrigeration components.

* * * * *